US005373819A

United States Patent [19]

Linder

[11] Patent Number: 5,373,819

[45] Date of Patent: Dec. 20, 1994

[54] ROTARY PISTON MACHINE AND METHOD OF MANUFACTURING PISTON

[76] Inventor: Renë Linder, Piazza Baraini, CH-6852 Genestrerio, Switzerland

[21] Appl. No.: 26,571

[22] Filed: Mar. 5, 1993

[30] Foreign Application Priority Data

Mar. 5, 1992 [CH] Switzerland ..... 00705/92

[51] Int. Cl.[5] ..... F02B 53/04

[52] U.S. Cl. ..... 123/238; 418/125; 418/168; 29/34 R; 29/888.04

[58] Field of Search ..... 123/234, 238; 418/164, 418/166, 168, 125; 29/34 R, 888.04, 888.041

[56] References Cited

U.S. PATENT DOCUMENTS

| | | | |
|---|---|---|---|
| 748,348 | 12/1903 | Cooley | 418/168 |
| 2,740,386 | 4/1956 | Grandall | 123/238 |
| 2,822,760 | 2/1958 | Schirmer et al. | 418/168 |
| 3,029,738 | 4/1962 | Clar | 418/168 |
| 3,760,777 | 9/1973 | Leroy et al. | 123/234 |
| 4,154,208 | 5/1979 | Kunieda et al. | 123/238 |
| 4,840,550 | 6/1989 | Baumgartner et al. | 418/168 |

FOREIGN PATENT DOCUMENTS

| | | | |
|---|---|---|---|
| 7614519 | 3/1978 | Netherlands | 418/125 |
| 453906 | 6/1968 | Switzerland . | |
| 470579 | 5/1969 | Switzerland . | |
| 989588 | 4/1965 | United Kingdom . | |

*Primary Examiner*—Richard A. Bertsch
*Assistant Examiner*—Charles G. Freay
*Attorney, Agent, or Firm*—Marks & Murase

[57] ABSTRACT

The rotary piston (6) with rotation axis C performs a relative rotation in an annular cylinder (1) with rotation axis O which is displaced with respect to said piston axis (C) by an eccentricity e. The cylinder (1) comprises three chambers (2) having cylindrical surfaces (3) which engage the piston (6). The piston (6) has two semi-cylindrical surfaces connected by connecting surfaces (8). Each connecting surface (8) has a shape generated by replacing one of the three rollers with a machine tool (5') and displacing the piston with the other two rollers (5). The surface of said piston (6) is continually supported on three rollers (5) of said cylinder (1). The relative position, i.e. the relative movement of said piston (6) and said cylinder (1), is rigidly determined by the support of the piston on rollers (5) and by the eccentricity (e) between the piston and the cylinder axes. The machine can be used as a combustion engine, a volumetric pump, or as a hydraulic motor. The rotational movements of the piston and of the cylinder are well equilibrated without any unbalance, and the machine can turn at high speeds without vibrations and without noise. As a combustion engine, it allows a high efficiency, a minimum pollution and a high specific power.

6 Claims, 8 Drawing Sheets

5
1m
6m
12a
33
12
3
1c
6c
30'
45'
60'
90'
120'
135'
165'
180'
67'30'
75'
105'
112'30'
157'30'
202'30'
287'30'

ROTARY PISTON MACHINE AND METHOD OF MANUFACTURING PISTON

SUMMARY OF THE INVENTION

The present invention refers to a rotary piston machine which can be designed as a compressor or a pump, a hydraulic or pneumatic motor, a combustion engine, or any combination of such machines. The object of the invention is to provide a rotary piston machine which is perfectly balanced and thus capable of rotating at very high speeds and of reducing fuel consumption, pollution and noise. This problem is solved by a rotary piston machine whose piston is displaceable in a cylinder, wherein said piston is supported externally by a three-point bearing and internally on an eccentric member, the relative position of said piston and of said cylinder being continually determined by the position of said eccentric member and of said three-point bearing; by a rotary piston machine wherein both a piston and its cylinder are rotating around two axes which are eccentric with respect to each other; and by a rotary piston machine wherein the circumference of said piston is in continuous contact with bearing and sealing rollers which are mounted in said cylinder.

SHORT DESCRIPTION OF THE DRAWINGS

The invention will be explained in more detail hereinafter with reference to the drawings, wherein FIG. 1 shows the constructional principle of the machine of the invention;

Figure 10:
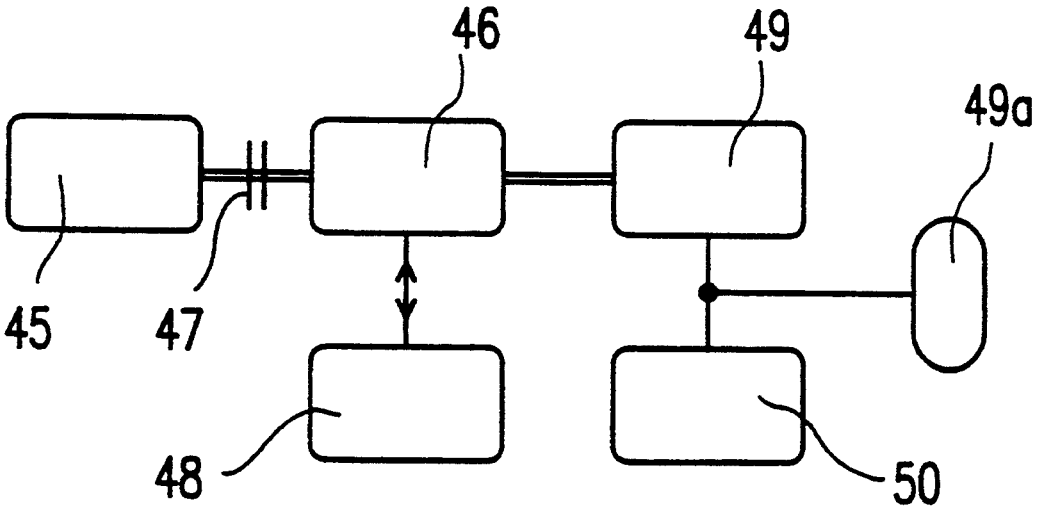

FIG. 10 schematically shows a use of three machines of the invention; and

Figure 11:
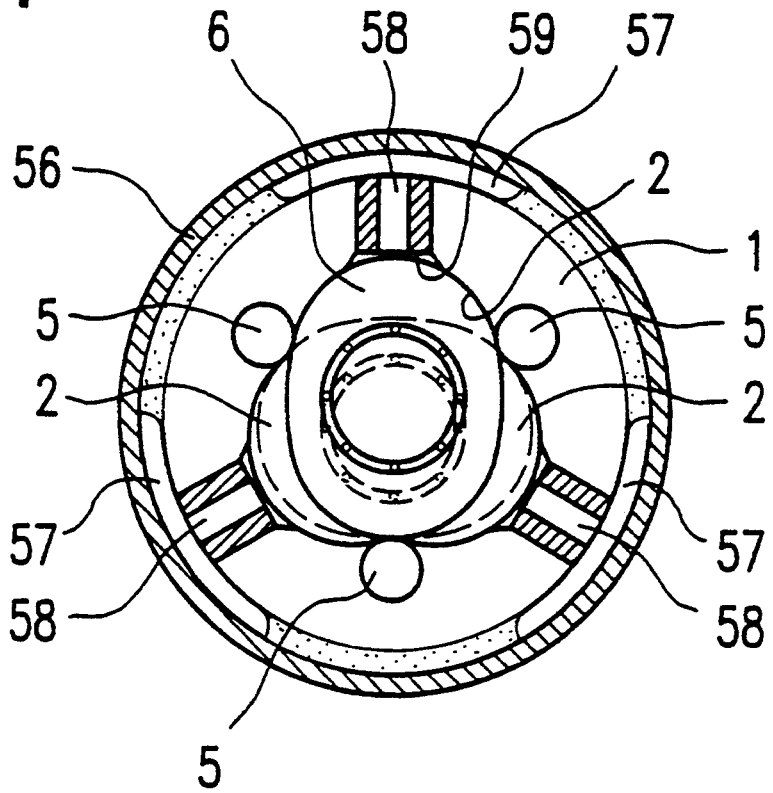
Figure 12:
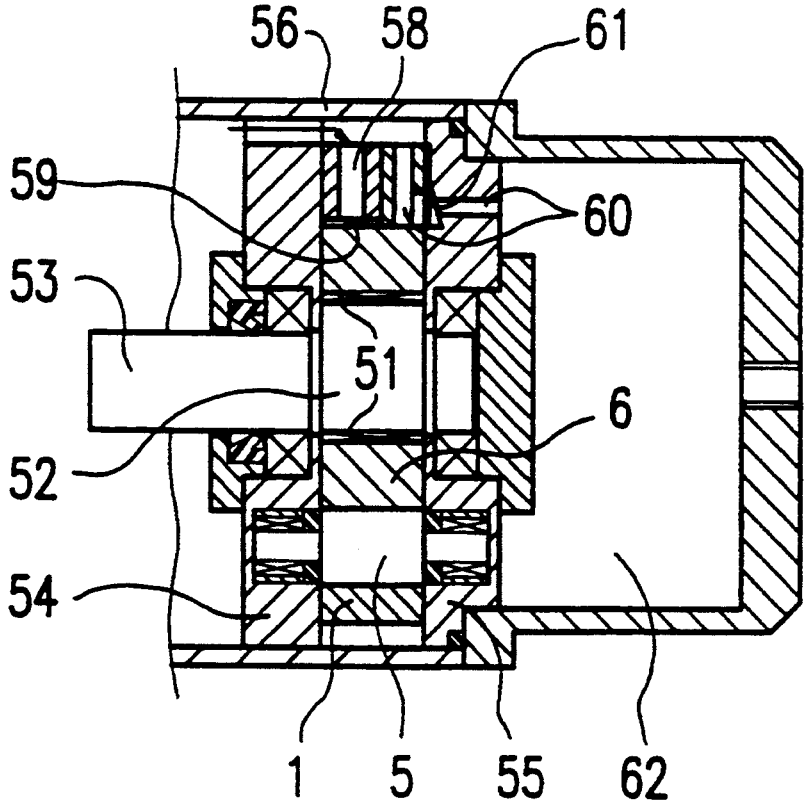

FIGS. 11 and 12 show a radial and an axial cross-section, respectively, of a compressor of the invention.

DETAILED DESCRIPTION OF THE INVENTION

Figure 1:
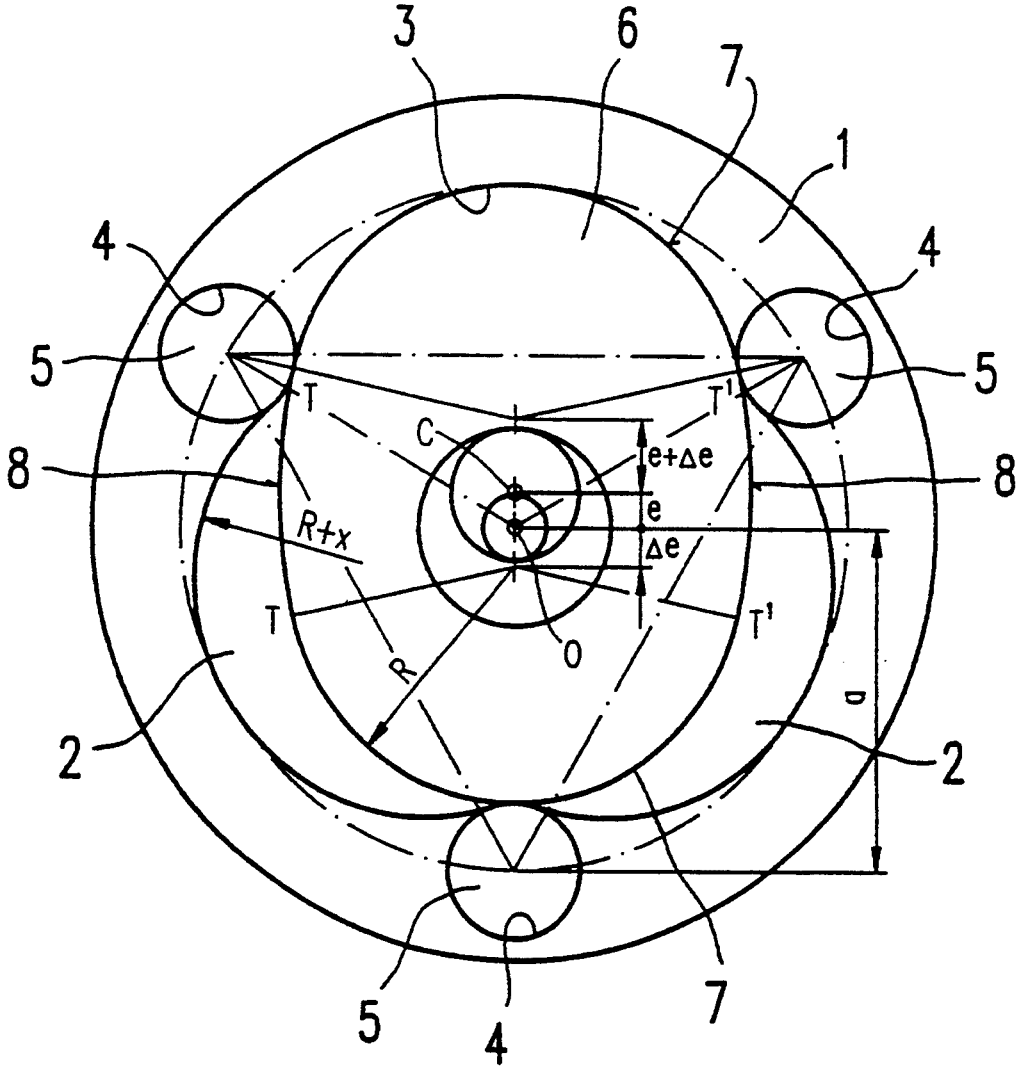
Figure 9:
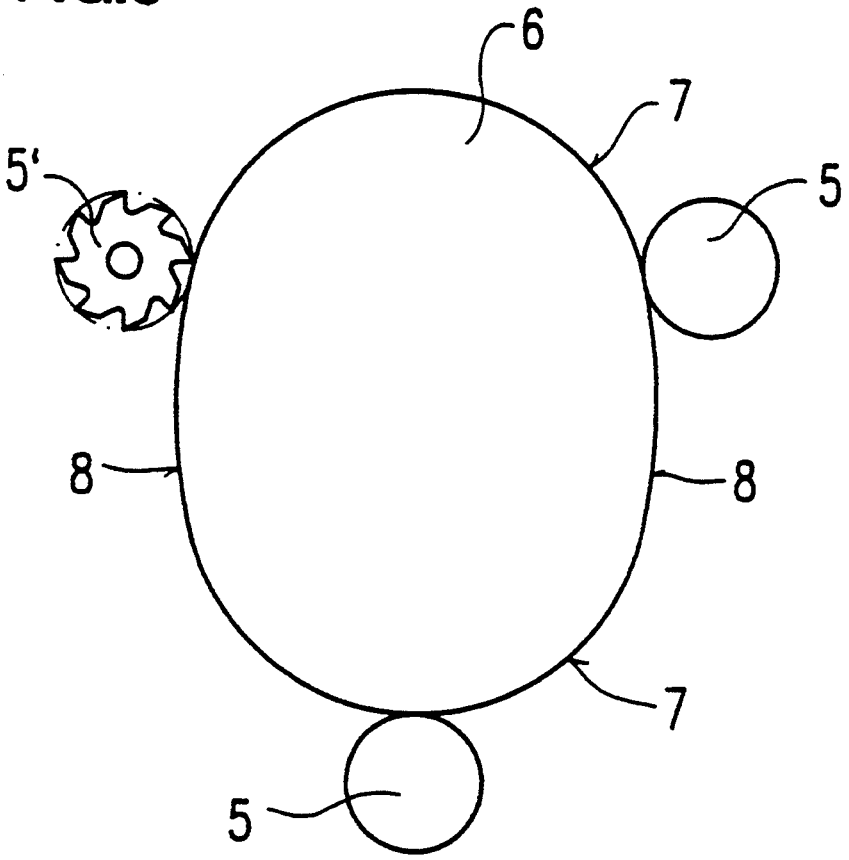
FIG. 9 shows a system for machining the rotary piston of the machine.

FIG. 1 represents the elements and the fundamental geometry of the active components of a machine of the invention. Said machine comprises an annular cylinder 1 which is internally provided with compartments or chambers 2. The three chambers 2 are displaced by 120°. Surfaces 3 delimiting chambers 2 are cylindrical surfaces with a radius R+x. Cylinder 1 is provided with three bores 4 which accommodate bearing and sealing rollers 5. Said rollers 5 are rotatively mounted in a manner explained herebelow, and they are symmetrically disposed between each pair of adjacent chambers 2. Rotary piston 6 of the machine has an elongated form with two cylindrical surfaces 7 which are symmetrically opposed and displaced by 180°. Said cylindrical surfaces 7 are connected by surfaces 8 whose exact form is determined experimentally or by a specific manufacturing process. In said process, cylindrical surfaces 7 are machined first. Said surfaces 7 are then supported on two rollers 5 and displaced on said rollers while one after the other of surfaces 8 is machined by a tool in the position of the third roller. FIG. 9 schematically shows this process. The already machined cylindrical surfaces 7 of piston 6 rest on two bearing rollers 5. The third bearing roller 5 is replaced with a cylindrical milling cutter 5'. As piston 6 is rotated on said two rollers 5 in the clockwise direction, milling cutter 5' will cut left surface 8. Piston 6 is then reversed in order to cut right-hand surface 8 by the same procedure. The piston thus obtained can be used as a model for series manufacture of identical pistons on a copying grinder.

While the cylinder axis coincides with the central axis O of the machine, piston 6 is mounted rotatively around a center or an axis C which is displaced with respect to axis O by a radial deviation or eccentricity e. The following list indicates the meaning of certain values of the designations in FIG. 1.

O=center of the machine

C=center of the rotor e=center distance between said two centers $\Delta e = e/\cos 30°$—important measure determining the length of surfaces 7

$a = 5e + 3e.\ \sqrt{3}$—centers of the bearing roller segments s=radius of the bearing roller segments $R = a - (s + \Delta e)$—radius of rotor surfaces 7

T—T and $T^1$—$T^1$—curve to be determined which provides continuous contact between the rotor and the rollers.

The rotor width is equal to its length minus 4e.

x=clearance which is necessary for the machine under construction, i.e. between the rounded edge of the rotor and the chamber occupied thereby in the apex of its path.

Figures 2A, 2B, 2C, 2D, 2E, 2F, 2G, 2H:
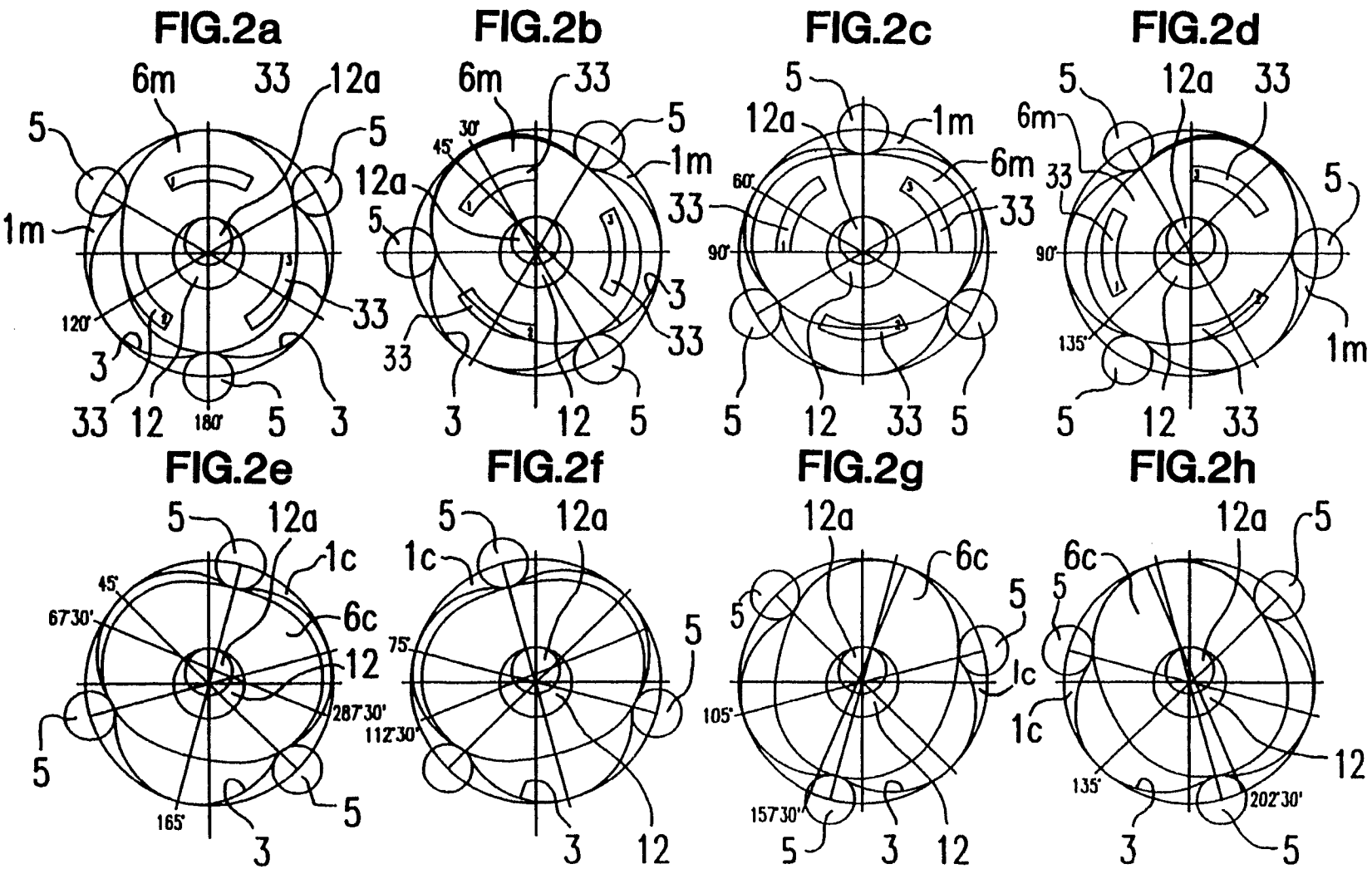
FIG. 2 shows a part of the working cycle of a combustion engine of the invention.

As mentioned above, the system according to FIG. 1 is conceived in such a manner that during rotation of cylinder 1, the relative position of said cylinder and of piston 6 is continually determined unequivocally by the continuous contact of the surface of piston 6 on said three bearing rollers 5 and the eccentricity of the piston axis. This situation is illustrated in FIG. 2 which will be explained below but which clearly shows the compulsory relative movement between the cylinder and the piston.

Figure 3:
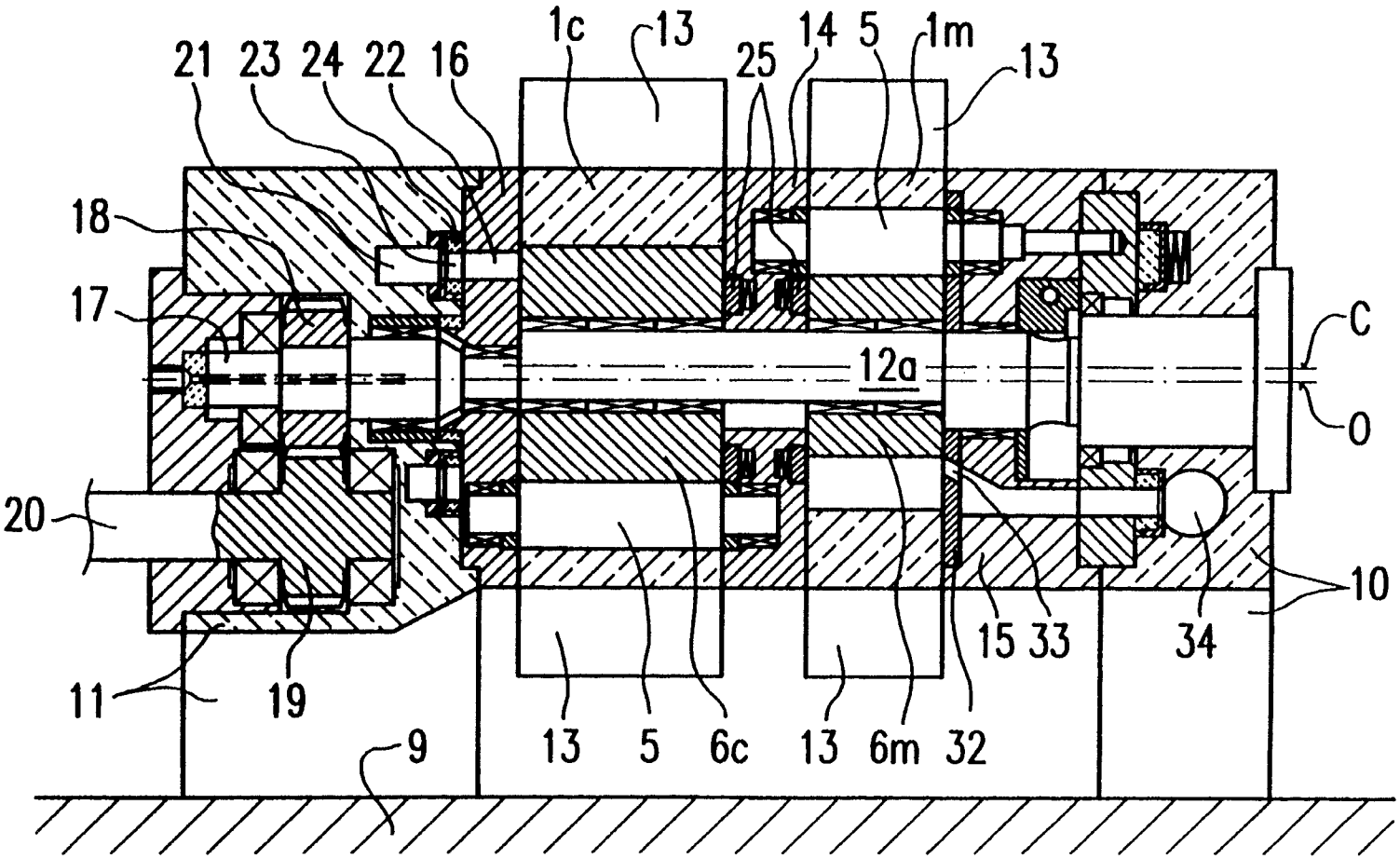
FIG. 3 shows a first axial cross-section of the combustion engine of the invention.

FIG. 3 shows an embodiment of a combustion engine of the invention. Said engine comprises a base 9 on which supports 10 and 11 are mounted, central main shaft 12 being secured in support 10. This means that said main shaft is stationary and supports the rotary components of the engine. Shaft 12 comprises an eccentric part **12*a* with an eccentricity e with respect to the central axis O of the engine. The engine comprises a motor part with a drive cylinder 1*m* and a compressor cylinder 1*c*. In the present embodiment, the compressor cylinder is 50% larger in the axial direction than the drive cylinder. Drive piston 6*m* and compressor piston 6*c* are rotatively mounted by means of needle bearings on eccentric part 12*a* of shaft 12. Cylinders 1*c* and 1*m* can be made of aluminum and may comprise cooling fins 13. FIG. 3 also shows one of the bearing and sealing rollers 5*m* and 5*c*, respectively, which are rotatively mounted in flanges, namely a medial flange 14 between the motor and the compressor, an exhaust flange 15 and a motor flange 16. Said flanges 14, 15, and 16 are rotatively mounted on non-eccentric parts of shaft 12 by means of needle bearings. All flanges 14, 15, and 16, as well as cylinders 1***c* and 1*m* are thus rotatively mounted around axis O. The compressor section and the motor section thus correspond to the principle explained with reference to FIG. 1. Shaft 12 is stationary relative to the machine, while separate shaft 17 rotates during operation. Flange 16 is in driving connection with shaft 17. Flange 16 extends from a rotatable shaft 17 which carries a driving pinion 18, said pinion meshing with a pinion 19 which is secured on motor shaft 20. Pinions 18 and 19 may be chosen according to the desired speed ratio between the motor and shaft 20.

Support 11 comprises an air inlet channel 21, and flange 16 has millings 22 allowing the inlet of air into the compressor. Said air inlet is controlled by passages 23 in a ceramic distributor flange 24. Opening and closing of said air passage in the compressor are automatically controlled by said distributor flange 24 without valves of any kind.

The medial flange comprises lateral sealing segments 25 which are pressed against the front faces of pistons 6*c* and 6*m*.

piston 6*m* to allow the exhaust of exhaust gases into an exhaust channel 34 as well as the rinsing of the engine by air before compression. Said automatic control of exhaust slots 33 by piston 6*m* is illustrated in FIG. 2 for an expansion cycle in one chamber of the cylinder and the exhaust and rinsing cycle, until the beginning of the compression, in the neighboring chamber, as well as for the compression phase in the third chamber of the cylinder. At the bottom of FIG. 2, the positions and the corresponding cycles of the compressor are shown. It is visible that the elements of the compressor are displaced with respect to the elements of the motor by approximately 45°.

Figure 4:
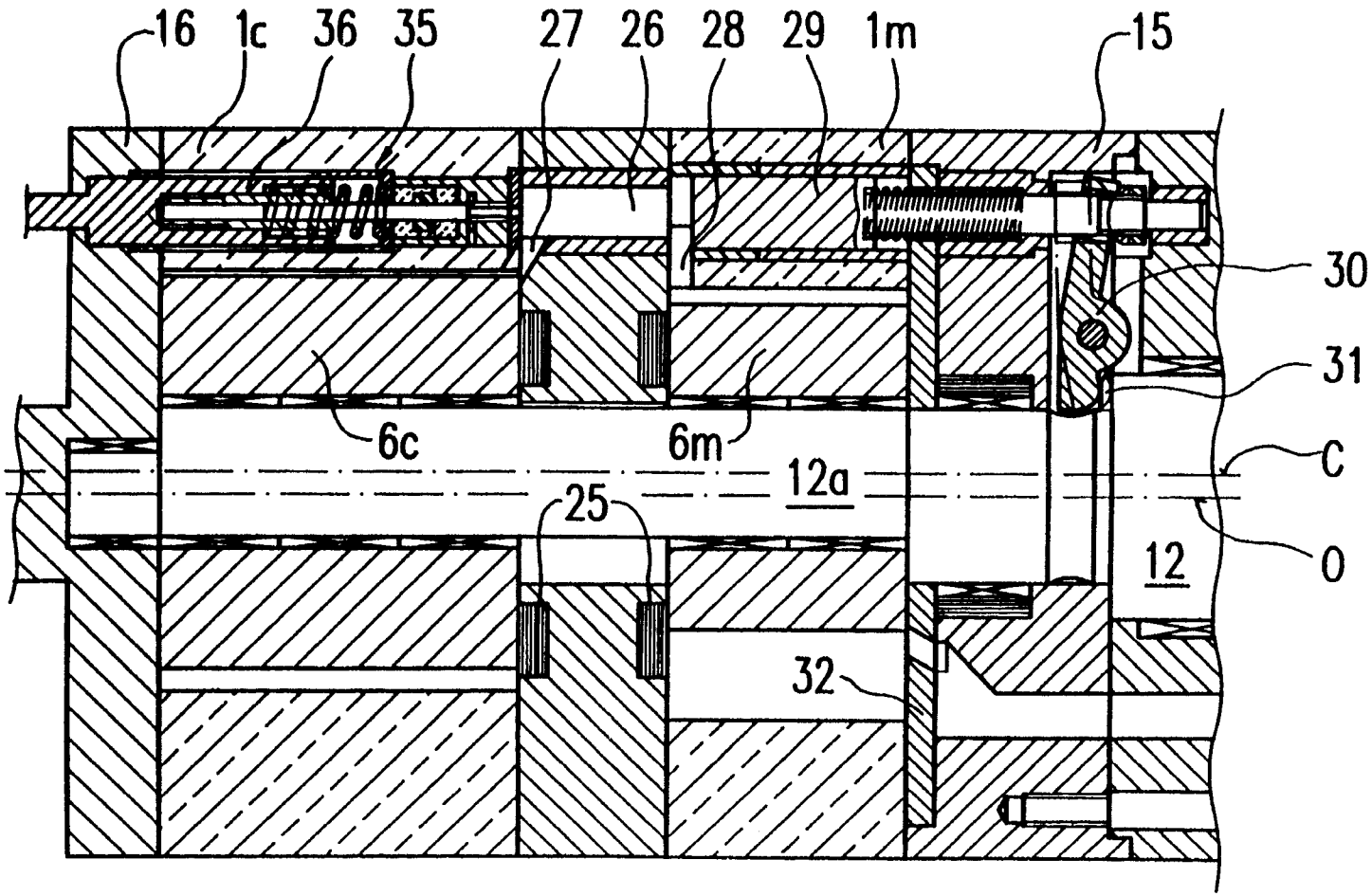
FIG. 4 shows a second axial cross-section of the combustion engine of the invention.

According to FIG. 4, fuel injectors 35 are disposed in compressor cylinder 1*c*. The injection nozzle of each of said injectors is located in front of air passage 26, and the injection piston 36 of each injector 35 is controlled by a non-represented cam in support 11. Three spark plugs (not shown) are disposed in suitable locations of the drive cylinder.

The following table provides the details of a complete cycle or revolution of the compressor and drive cylinders.

Rotary and volumetric cycle of the engine
Important: the compressor cylinder precedes the drive cylinder by 45°.
Cylinder positions in 15° steps; amounts of air aspirated or compressed in the chambers in %; explanations of the cycle.

| Compressor cyl. | Inlet in % | Drive cyl. | Compression in % | Exhaust | Explosion | Cycle |
|---|---|---|---|---|---|---|
| 0° | start | 315° | 91% | | | compression |
| 15° | 1% | 330° | 96% | | | compression |
| 30° | 4% | 345° | 98–99% | | | compression |
| 45° | 9% | 360° | 100% | | ignition | end of comp. + |
| 60° | 18% | 15° | expansion of gases | | ******** | end of cycle |
| 75° | 28% | 30° | " | | ******** | |
| 90° | 42% | 45° | " | | ******** | |
| 105° | 56% | 60° | " | | ******** | |
| 120° | 69% | 75° | " | | ******** | |
| 135° | 81% | 90° | " | | ******** | |
| 150° | 91% | 105° | " | | ******** | |
| 165° | 97% | 120° | " | start | ******** | end gas expansion |
| 180° | 100% | 135° | | ******** | | exhaust |
| 195° | compression | 150° | | ******** | | exhaust |
| 210° | 9% | 165° | | ******** | | exhaust |
| 225° | 18% | 180° | start air inlet | ******** | | forced exhaust |
| 240° | 31% | 195° | chamber rinsing | ******** | | forced exhaust |
| 255° | 44% | 210° | chamber rinsing | ******** | | forced exhaust |
| 270° | 58% | 225° | chamber rinsing | ******** | injection | forced exhaust |
| 285° | 71% | 240° | start compress. | | injection | end of exhaust |
| 300° | 82% | 255° | compress. + air | | injection | compression |
| 315° | 91% | 270° | compress. + air | | end inj. | compression |
| 330° | 96% | 285° | compress. + air | | | compression |
| 345° | 99% | 300° | compress. + air | | | compression |
| 360° | 100% | 315° | end of air inl. | | | compression |

Characteristics of the rotary engine:
i) Rotary engine composed of two cylinders rotating on one shaft and of two rotors rotating on a second shaft with a center distance 'e' between said shafts.
ii) The first cylinder is the compressor and is 50% larger than the drive cylinder which is disposed 45° behind the compressor.
iii) This arrangement provides already compressed air in order to rinse the motor chambers at the end of the gas expansion until the closing of the exhaust and before injection.

In FIG. 4, where the elements of the engine are designated by the same numerals as in FIG. 3, it appears that air passages 26 are disposed between the compressor section and the motor section. Said passages 26 communicate with the compressor by inclined slots 27 and with the motor by slots 28. Pistons 29 act as valves to open and close the passage between the compressor and the motor, and said valve pistons 29 are controlled by levers 30 which are actuated by a cam surface 31 of shaft 12, i.e. an annular cam which is mounted on said shaft. Flange 15 comprises an exhaust control flange 32. Flange 32 is provided with slots 33 which are automatically opened and closed by the relative movement of The conception of the described motor, i.e. of the machine of the present invention, fundamentally distinguishes itself from known machines by the fact that an annular cylinder is rotatively driven with an internal rotary piston, the relative position of the cylinder and of the piston being rigidly determined at all times by the continuous contact of the piston with bearing and sealing rollers of the cylinder and by the eccentricity of the axes of the cylinder and of the piston. The driving torque of the motor is obtained as a result of the eccentricity between the axes of the cylinder and of the piston. It is understood that the illustrated motor comprises a non-represented protection cover which is attached to base 9 and surrounds the rotary components of the motor.

Figure 5:
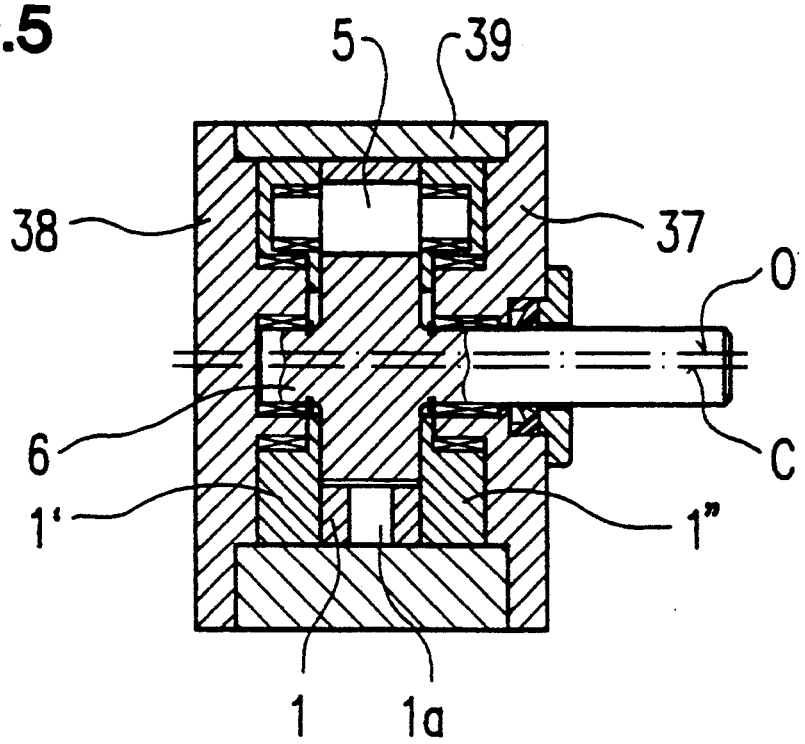
FIGS. 5 and 6 show an axial and a radial cross-section, respectively, of a pump or a compressor of the invention.
Figure 6:
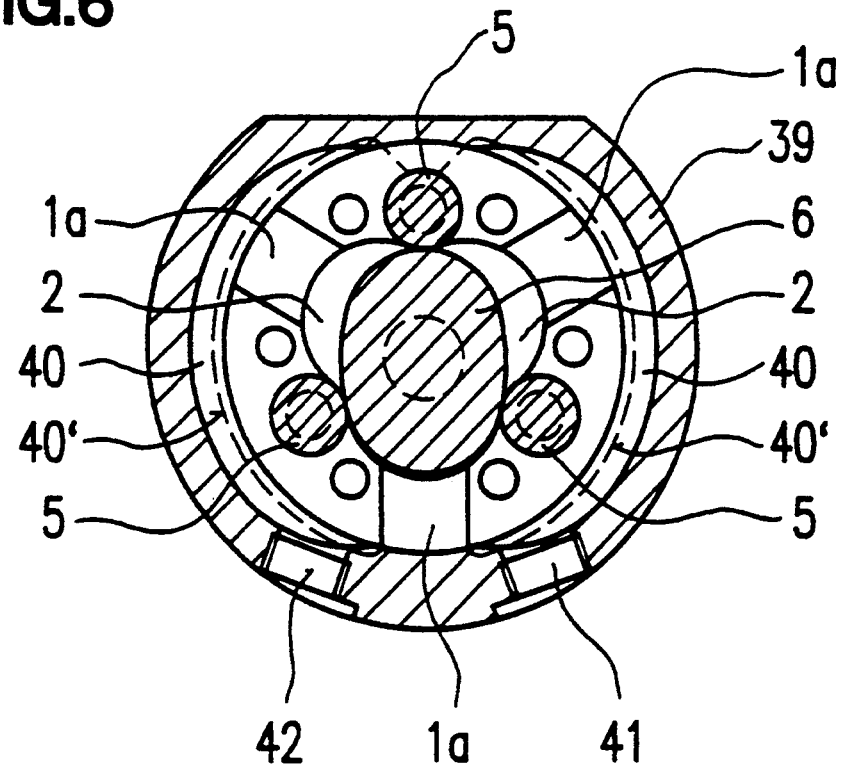

FIGS. 5 and 6 show a volumetric pump of the invention. The same reference numerals as in FIG. 1 are being used. Cylinder 1 with its flanges 1' and 1'' is mounted in a pump casing having flanges 37 and 38 which are connected by a mantle 39. Axis O of cylinder 1 is displaced by eccentricity e with respect to rotational axis C of rotary piston 6 which is fixed to its shaft. Each chamber 2 of the cylinder communicates with a radial channel 1*a*. Cylinder 1 is surrounded by two chambers 40 in the casing of the pump, and said chambers communicate with an inlet duct 41 and a pressure duct 42. In order to compensate the radial pressure of the compressed fluid in one of chambers 40 upon the rotary part of the pump, compensation channels 40' whose surface is equal to that of a chamber 40 are provided. The channel opposite chamber 40 under pressure is connected to said chamber in order to compensate the radial pressure produced by chamber 40 under pressure.

According to the direction of rotation of the driving shaft and of rotary piston 6, the fluid is aspirated through one of ducts 41 or 42 and is driven out through the other one of said ducts. In this case, it is driven piston 6 which drives cylinder 1 in a movement which is rigidly determined by the continuous contact of the piston surface with bearing rollers 4 and by the eccentricity of the piston axis with respect to the cylinder axis.

Figure 8:
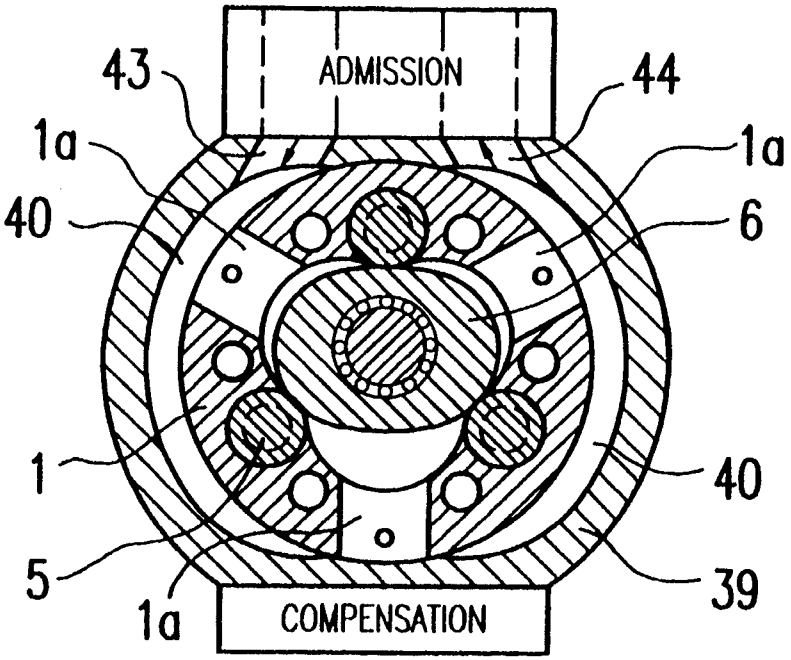
FIGS. 7 and 8 are radial cross-sections of a hydraulic or pneumatic motor of the invention in two typical positions of the working cycle.
Figure 7:
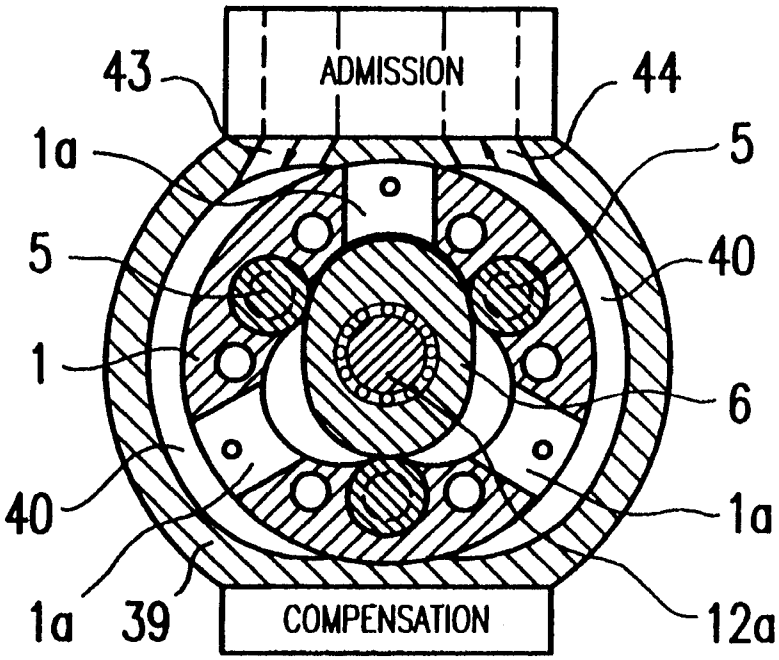

The construction of the hydraulic motor according to FIGS. 7 and 8 is substantially equivalent to that of the pump according to FIGS. 5 and 6. Consequently, corresponding elements are designated by the same reference numerals in FIGS. 5 through 8. The fluid under pressure is supplied through duct 43 and leaves the motor by a return duct 44. In particular, the motor distinguishes itself from the pump by the fact that rotary piston 6 is rotatively mounted on an eccentric shaft 12*a* while the driving shaft of the motor is connected to cylinder 1.

Both in the pump of FIGS. 5 and 6 and in particular in the motor of FIGS. 7 and 8, it is advisable to compensate the greater force acting upon the cylinder from the pressure side by an equivalent counter-pressure.

In order to prevent an excessive pulsation of the pressure fluid consumption by the motor or of the pressure fluid output by the pump, two or more motors or pumps with phase-shifted working cycles can be arranged in parallel.

The combustion engine, the hydraulic pump and the hydraulic motor described hereinbefore may preferably be used in combination for a hydraulic or hydroelectric drive of a vehicle.

Three components are necessary to solve this problem, namely:

i) a rotary motor as described above;

ii) the hydraulic drive of the vehicle;

iii) a dynamo/motor of a certain power; a solution which is already being used by certain constructors.

FIG. 10 schematically shows the elements of such a drive. Combustion engine 45 drives a generator/electric motor 46 via clutch 47. Generator 46 is connected to a battery 48 and to a pump 49 having a pressure accumulator 49*a* which is capable of feeding a hydraulic motor 50 for driving the wheels of the vehicle. It is understood that FIG. 10 does not show the necessary electric and hydraulic circuits for the control of the system.

In the country, the above-mentioned combustion engine and hydraulic drive could be used. In the meantime, the dynamo/motor will charge the batteries required afterwards. With regard to the size of said dynamo/motor, supplied power will be utilized but not lost.

In town, the pump which is necessary to supply the hydraulic motors will be disengaged from the combustion engine and driven by the dynamo/motor and the batteries. This is not complicated and is feasible since the speed of vehicles is limited in urban areas and less driving power is required. Also, there are many traffic stops where the dynamo/motor will not be in use, thus saving electricity, which is important for the capacity of the batteries which should ensure an operating radius of the vehicle of 25 to 30 km in urban areas.

In variants of the system of FIG. 10, four hydraulic motors can be provided instead of a single motor, or two double differentials which are supplied by pump 49 or by pressure accumulator 49*a*. A radiator for cooling the oil can be provided in the hydraulic circuit.

For speed shifting, two hydraulic motors having a greater capacity and two motors having a smaller capacity can be provided. For starting and in the first gear, all four hydraulic motors will be used. In the second gear, the two motors having a greater capacity will be used as a drive, and in the third gear, the two motors having a smaller capacity will be used. In this manner, the flow will vary very little, thus requiring only small decelerations or accelerations of the combustion engine. The hydraulic motors can be integrated in the wheels of the vehicle.

The advantages offered by this novel drive should not be underestimated and are very important for the future. Atmospheric pollution in the cities is unacceptable for the population, and the present solution for vehicles will reduce said pollution by a great percentage. The same applies for annoyances caused by noise, said noise being substantially eliminated.

In FIGS. 11 and 12, which illustrate a compressor, e.g. for a refrigerator, the corresponding elements are designated by the same reference numerals as in the preceding figures. Piston 6 is rotatively mounted by means of a needle bearing 51 on an eccentric portion 52 of driving shaft 53. Said shaft 53 and bearing rollers 5 rotate on bearings which are mounted in flanges 54 and 55, said flanges being mounted in a casing 56. The gas to be compressed is supplied to chambers 2 of cylinder 1 through inlet channels 57 and 58. Nonreturn valves 59 inside channels 58 allow the inlet of the gas to chambers 2 but prevent its return. Exhaust channels 60, which are also provided each with a nonreturn valve 61, allow the outlet of the compressed gas from chambers 2 into a pressure reservoir 62.

By the rotation of shaft 53, piston 6 is displaced in a forced movement which is determined at all times by the three-point support on rollers 5 and by the position of eccenter 52 as described hereinbefore. Said gas is alternatingly aspirated into chambers 2, compressed therein and supplied to reservoir 62. The compressor of FIGS. 11 and 12 may comprise at least two cylinders 1 and two pistons 6 on the same shaft which are angularly displaced for a better balance of the machine.

I claim:

1. Method of making rotary pistons for a rotary piston machine having three supporting and sealing rollers comprising the steps of:

machining two diametrically opposite substantially semi-cylindrical surfaces of said piston first;

supporting said substantially semi-cylindrical surfaces on two rollers whose positions correspond to that of two supporting and sealing rollers in said rotary piston machine;

disposing a machine tool in a position corresponding to that of the remaining third supporting and sealing roller, said machine tool having an axis and a diameter identical to the third supporting and sealing roller;

displacing the piston along the two rollers supporting said substantially semi-cylindrical surfaces; and machining connecting surfaces between said substantially semi-cylindrical surfaces when said piston travels by said machine tool;

placing said piston in said rotary machine having a cylinder disposed on an axis which is displaced eccentrically from a piston axis about which said rotary piston rotates, said cylinder further comprising three chambers, each chamber being displaced by 120° from the other chambers and each chamber having a substantially semi-cylindrical surface, wherein said substantially semi-cylindrical surfaces of the piston enter into said substantially semi-cylindrical chambers of the cylinder in a cyclic displacement of said piston and said cylinder relative to each other upon relative rotation of said piston and cylinder, said three supporting and sealing rollers being disposed between adjacent chambers of said cylinder; whereby, said supporting and sealing rollers are in continuous supporting and sealing contact with said substantially semi-cylindrical surfaces and said connecting surfaces of the piston during relative rotation of said piston in said cylinder.

2. A method according to claim 1, further comprising the step of duplicating said piston prior to said placing step.

3. A method according to claim 2, wherein the duplicating step comprises grinding copies of said piston.

4. Method for generating surfaces of a rotary piston comprising the steps of machining substantially semi-cylindrical surfaces of a piston;

supporting said substantially semi-cylindrical surfaces of said piston on two rollers;

said two rollers being disposed at positions displaced 120 degrees apart from one another;

disposing a machine tool in a position displaced 120 degrees from each of said positions of said two rollers;

displacing the piston along said two rollers; and machining connecting surfaces on said piston between said substantially semi-cylindrical surfaces as said piston travels by said machine tool.

5. An apparatus for generating surfaces of a rotary piston comprising:

two rollers and a machine tool each disposed 120 degrees from each other;

advancing means for advancing the rotary piston along the two rollers to the machine tool;

said machine tool cutting connecting surfaces between substantially semi-cylindrical surfaces of said rotary piston as the rotary piston is advanced.

6. A combustion engine comprising:

a motor section for combusting fuel;

a compressor section for feeding air to said motor section;

valves located between said compressor section and said motor section, said valves being controlled by a cam; wherein, said motor section and said compressor section each have a rotary piston machine comprising, a piston rotatable around a piston axis and a cylinder having an axis displaced eccentrically from said piston axis;

said piston comprising two diametrically opposite substantially semi-cylindrical surfaces and connecting surfaces between said semi-cylindrical surfaces;

said cylinder having three chambers, each chamber being displaced by 120° from the other chambers and each chamber having a substantially semi-cylindrical surface, wherein said substantially semi-cylindrical surfaces of the piston enter into said substantially semi-cylindrical chambers of the cylinder in a cyclic displacement of said piston and said cylinder relative to each other upon relative rotation of said piston and cylinder;

said cylinder having three supporting and sealing rollers, each disposed between adjacent chambers;

said supporting and sealing rollers being in continuous supporting and sealing contact with said substantially semi-cylindrical surfaces and said connecting surfaces of the piston during relative rotation of said piston in said cylinder, wherein each of said connecting surfaces comprises a contour generated by supporting said piston on two of said supporting and sealing rollers and machining one of said connecting surfaces with a tool having an axis and a diameter identical to the third of said supporting and sealing rollers; and wherein, the rotary cylinder of the motor section is coupled to and substantially similar to the rotary cylinder of the compressor section.

* * * * *